US009421585B2

(12) United States Patent
Schwab et al.

(10) Patent No.: US 9,421,585 B2
(45) Date of Patent: Aug. 23, 2016

(54) HIGH-PRESSURE CLEANING APPLIANCE

(75) Inventors: Werner Schwab, Rudersberg (DE); Johannes Goetz, Leutenbach (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 1160 days.

(21) Appl. No.: 13/434,931

(22) Filed: Mar. 30, 2012

(65) Prior Publication Data

US 2013/0074883 A1 Mar. 28, 2013

Related U.S. Application Data

(63) Continuation of application No. PCT/EP2009/063437, filed on Oct. 14, 2009.

(51) Int. Cl.
*B08B 3/10* (2006.01)
*B08B 3/02* (2006.01)

(52) U.S. Cl.
CPC ... *B08B 3/10* (2013.01); *B08B 3/02* (2013.01); *B08B 3/026* (2013.01); *B08B 2203/007* (2013.01); *B08B 2203/0211* (2013.01)

(58) Field of Classification Search
CPC ..... B08B 3/02; B08B 3/10; B08B 3/026; B08B 2203/207; B08B 2203/0211
See application file for complete search history.

(56) References Cited

U.S. PATENT DOCUMENTS

| | | | | |
|---|---|---|---|---|
| 3,477,688 | A * | 11/1969 | Cruse | 251/149.9 |
| 4,865,255 | A * | 9/1989 | Luvisotto | A01M 7/0035 239/149 |
| 5,245,714 | A | 9/1993 | Haraga et al. | |
| 5,411,421 | A * | 5/1995 | McCardell, Jr. | 439/879 |
| 6,695,235 | B2 * | 2/2004 | Faller et al. | 239/722 |
| 2003/0080222 | A1 | 5/2003 | Faller et al. | |
| 2008/0128032 | A1 | 6/2008 | Lapetina et al. | |

FOREIGN PATENT DOCUMENTS

| | | |
|---|---|---|
| DE | 36 17 556 | 12/1987 |
| DE | 93 03 648 | 8/1993 |
| DE | 44 45 521 | 12/1995 |
| DE | 196 07 882 | 2/1997 |
| EP | 0 890 394 | 1/1999 |
| WO | WO 2008/030799 | 3/2008 |

* cited by examiner

*Primary Examiner* — David Cormier
(74) *Attorney, Agent, or Firm* — Lipsitz & McAllister, LLC

(57) ABSTRACT

The invention relates to a high-pressure cleaning appliance comprising a first functional device required for operation in the form of a heatable heat exchanger for heating a liquid that is dischargeable from the high pressure cleaning appliance, and at least one further, second functional device required for operation which is arranged below the heat exchanger. In order to develop such a high-pressure cleaning appliance such that it is more user friendly to maintain, the invention proposes that the high-pressure cleaning appliance comprise a first appliance unit having a carrying device on which the heat exchanger is held, and a second appliance unit having a support device on which the at least one second functional device is held, and that the carrying device be releasably connectable to the support device in a force-locked and/or positively-locked manner.

14 Claims, 7 Drawing Sheets

HIGH-PRESSURE CLEANING APPLIANCE

This application is a continuation of international application number PCT/EP2009/063437 filed on Oct. 14, 2009.

The present disclosure relates to the subject matter disclosed in international application number PCT/EP2009/063437 of Oct. 14, 2009, which is incorporated herein by reference in its entirety and for all purposes.

BACKGROUND OF THE INVENTION

The invention relates to a high-pressure cleaning appliance comprising a first functional device required for operation in the form of a heatable heat exchanger for heating a liquid that can be discharged from the high pressure cleaning appliance, and at least one further, second functional device required for operation which is arranged below the heat exchanger.

High-pressure cleaning appliances of the generic kind are known in which labour-intensive disassembly of the high-pressure cleaning appliance is required to perform maintenance on the at least one second functional device which is arranged inaccessibly below the heat exchanger. Experience shows that in particular the removal of the heat exchanger in order to gain access to the at least one second functional device requires considerable time.

It is an object of the present invention to develop a high-pressure cleaning appliance of the kind mentioned at the outset such that it is more user friendly to maintain.

SUMMARY OF THE INVENTION

In accordance with the invention, this object is achieved in a high-pressure cleaning appliance of the generic kind by the high-pressure cleaning appliance comprising a first appliance unit having a carrying device on which the heat exchanger is held, and a second appliance unit having a support device on which the at least one second functional device is held, and by the carrying device being releasably connectable to the support device in a force-locked and/or positively-locked manner.

The high-pressure cleaning appliance in accordance with the invention comprises a first appliance unit and a second appliance unit including a carrying device and a support device respectively. The carrying device can be releasably connected to the support device in a force-locked and/or positively-locked manner. The high-pressure cleaning appliance can be disassembled by releasing this force-locked and/or positively-locked connection between the carrying device and the support device. This allows the first appliance unit to be brought in spaced relation to the second appliance unit. Because the heat exchanger is held on the first appliance unit and in particular on the carrying device and the at least one second functional device is held on the second appliance unit and in particular on the support device, this provides a simple and time-saving way of bringing the heat exchanger in spaced relation to the at least one second functional device. This makes it easier for a user to access the at least one second functional device for maintenance so that the high-pressure cleaning appliance in accordance with the invention proves to be more maintenance friendly than high-pressure cleaning appliances of the generic kind.

For maintenance, the at least one second functional device can continue to be held on the support device and/or the heat exchanger can continue to be held on the carrying device. In particular, this provides a way of performing a functional test on the high-pressure cleaning appliance when the appliance units are brought in spaced relation to each other. This saves a user from having to first fully reassemble the high-pressure cleaning appliance before a functional test can be performed after conducting maintenance on, for example, the at least one second functional device.

The at least one second functional device is in particular configured as a pump set for increasing the liquid pressure, and/or as a motor for the pump set, and, where applicable, as a fan for generating a flow of air cooling the motor, and/or as a blower wheel for generating a flow of combustion air for the heat exchanger, and/or as a fuel pump for delivering a fuel for the heat exchanger, and/or as an electrical device of the high-pressure cleaning appliance. Therefore, the at least one second functional device can also comprise a plurality of components of the high-pressure cleaning appliance. By way of example, it may be a unit formed by the pump set and the motor or it may be an assembly formed by the pump set, the motor, the blower wheel and the fuel pump.

It is advantageous for the at least one second functional device or a cover of the at least one second functional device to be freely accessible to a user after releasing the carrying device from the support device because such a high-pressure cleaning appliance is even more maintenance friendly. This can be implemented, for example, by the first appliance unit covering the second appliance unit when connected together and by the at least one second functional device being arranged on an upper side of the second appliance unit. After the carrying device and the support device have been released from one another, the first appliance unit can be brought in spaced relation to the second appliance unit for free accessibility of the at least one second functional device or, where applicable, a cover of same.

Preferably, the carrying device has a first carrying part for holding the heat exchanger, said first carrying part being releasably connectable to one or more support elements comprised by the support device. With the carrying device and the support device in the condition in which they are connected together, the first carrying part with the heat exchanger held thereon can be supported on the one or more support elements. This allows a force-locked connection of the carrying device with the support device by utilizing the weight exerted on the heat exchanger and thus on the first carrying part. In addition, provision may be made for the first carrying part to be connectable to the one or more support elements by use of one or more connecting elements to form an additional, releasable, positively-locked connection.

It is advantageous for two or more support elements to be provided, which in each case form an abutment face and in particular a support face for the first carrying part on their respective sides that face towards the first appliance unit. The first carrying part can abut the abutment face or be supported on the support face to form a force-locked connection of the carrying device with the support device.

A simple design of the carrying device can be achieved by the first carrying part having a plate-shaped configuration and forming a supporting surface for the heat exchanger. The heat exchanger can stand on the supporting surface, it being possible for the heat exchanger to be held by way of connecting elements on the first carrying part and thus on the carrying device. Advantageously, the plate-shaped carrying part abuts the abutment faces and is in particular supported on the support faces of the two or more support elements. By way of example, this allows a reliable force-locked connection of the carrying device with the support device to be formed utilizing the weight of the heat exchanger.

It is advantageous for a receiving space for the at least one second functional device to be formed below the first carrying part. If the first carrying part is of plate-shaped configuration as described above, it can delimit the receiving space for example on the upper side thereof. The receiving space may, for example, be formed by the one or more support elements projecting in a height direction starting from an upper side of the support device and forming in each case an abutment face, and in particular a support face, for the first carrying part on their respective sides that face towards the first appliance unit. Alternatively or additionally, provision may be made for the support device to form a recess for receiving the at least one second functional device which is at least partially covered on the upper side by the first carrying part.

It is advantageous for the carrying device to have at least one second carrying part that is fixed to the first carrying part and for the support device to comprise at least one receptacle for the at least one second carrying part. The use of the at least one second carrying part allows the carrying device to be given greater stability and the weight of the first appliance unit to be transferred to the second appliance unit in a more uniformly and better-distributed manner.

Preferably, the at least one second carrying part engages in a positively-locked manner in the at least one receptacle comprised by the support device. This makes it possible to form a positively-locked connection between the carrying device and the support device. By releasing the at least one second carrying part from the receptacle, it is possible to release this positively-locked connection between the carrying device and the support device.

To achieve a simple design of the carrying device, it has proved advantageous for the at least one second carrying part to be configured as a profile bar extending in a direction of height. The at least one receptacle of the support device for the at least one second carrying part is advantageously configured as a blind hole or as a sleeve in which the profile bar can engage in a positively-locked manner. In addition, the profile bar can be supported on the support device at a bottom of the blind hole or sleeve. This is a simple design for transferring the weight of the first appliance unit via the carrying device to the second appliance unit.

In a particularly advantageous embodiment of the high-pressure cleaning appliance in accordance with the invention, the first carrying part is of plate-shaped configuration as described above, and the at least one second carrying part is configured as a profile bar as described above. The profile bar extends through the plate-shaped first carrying part to achieve a stable design of the carrying device and is fixed thereto, for example by screwing. The profile bar engages in a positively-locked manner in a blind hole-like or sleeve-like receptacle of the support device, and the plate-shaped first carrying part is supported on one or more support elements of the support device and covers a receiving space for the at least one second functional device.

It is advantageous for the carrying device to comprise two second carrying parts because this permits the carrying device to be designed for greater stability. It is advantageous for each of the two second carrying parts to be in the form of the profile bar described above and to engage in a receptacle of the support device in a positively-locked manner.

On their respective upper sides, the two second carrying parts are preferably connected together by a connecting member that forms a handle element for the high-pressure cleaning appliance. For example, the user can engage the handle element to move the high-pressure cleaning appliance on a set-down surface. Furthermore, the user can engage the handle element in order to release the carrying device from the support device, thereby bringing the first appliance unit in spaced relation to the second appliance unit.

Preferably, the high-pressure cleaning appliance includes a housing having at least one housing wall which is held on the carrying device. By use of the housing, the functional devices of the high-pressure cleaning appliance can be protected and a more pleasing appearance can be given to the high-pressure cleaning appliance. Furthermore, retaining the at least one housing wall on the carrying device and in particular on the second carrying part thereof simplifies the construction of the high-pressure cleaning appliance. As part of the first appliance unit, the at least one housing wall can be brought in spaced relation to the second appliance unit.

Provision may be made for the at least one housing wall to form a rear wall of the housing. The rear wall may also form parts of side walls of the housing, for example part of a left side wall and/or part of a right side wall of the housing.

It is advantageous for the support device to form a trough-shaped depression in which the first appliance unit is partially arranged, wherein an edge bordering the depression abuts the side of the at least one housing wall which faces towards the support device. The second appliance unit and in particular a section of the at least one housing wall which faces towards the support device can be arranged within the depression. The at least one housing wall abuts an edge of the depression. This makes it possible to form a positively-locked connection of the edge and therefore the depression with the at least one housing wall. The at least one housing wall and with it the first appliance unit can be fixed relative to the support device and with it relative to the second appliance unit in this manner.

It is advantageous for the support device to form a chassis for the high-pressure cleaning appliance. The high-pressure cleaning appliance can thereby be given a simpler design. By way of example, wheels for the high-pressure cleaning appliance can be held on the chassis. The carrying device and thus the first appliance unit can be supported on the chassis. The at least one second functional device is advantageously arranged on an upper side of the chassis so that it is easily accessible to a user once the carrying device has been released from the chassis.

A simple and cost-effective design of the support device is obtained if it is formed in a one-piece configuration and/or made of a plastics material.

In the high-pressure cleaning appliance in accordance with the invention, the at least one second functional device is held on the support device. It has already been mentioned that the at least one second functional device is for example a pump set, a motor, a fan, a blower wheel, a fuel pump, and/or an electrical device of the high-pressure cleaning appliance. If the second appliance unit comprises more than only one functional device, then the high-pressure cleaning appliance can be constructed to be more compact. It is also possible for the second appliance unit to comprise a functional device receptacle for a functional device.

In like manner, to achieve a more compact construction of the high-pressure cleaning appliance it is advantageous for the first appliance unit to comprise, in addition to the heat exchanger, at least one further functional device required for operation of the high-pressure cleaning appliance and/or a functional device receptacle for a further functional device.

It is advantageous for the first appliance unit to comprise a fuel container for a fuel required for operation of the heat exchanger, and/or a hose reel to receive a high-pressure hose, and/or a handle element to move the high-pressure cleaning appliance. The fuel container is a functional device of the high-pressure cleaning appliance and the hose reel is a functional device receptacle for a high-pressure hose for operation of the high-pressure cleaning appliance.

Preferably, the functional devices and/or functional device receptacles for functional devices required for operation of the high-pressure cleaning appliance are all comprised by the first appliance unit and/or the second appliance unit. This allows the construction of the high-pressure cleaning appliance to be particularly compact, the functional devices or functional device receptacles all being part of the first appliance unit or the second appliance unit.

Preferably, the high-pressure cleaning appliance comprises a pump set for increasing the liquid pressure, said pump set being connected to the heat exchanger via a liquid discharge conduit, wherein the liquid discharge conduit can be releasably connected to the pump set and/or the heat exchanger without the use of tools. This simplifies maintenance of the high-pressure cleaning appliance. The first and second appliance units can be brought in spaced relation more easily in this manner.

For the same reason, it is also advantageous for electrically operative components of the high-pressure cleaning appliance to be interconnectable via one or more electrical lines without the use of tools. The electrically operative components and the one or more electrical lines may, for example, be interconnected by plug connections. The plug connections can be easily disconnected without the use of tools by the user for simplified maintenance of the high-pressure cleaning appliance.

It is advantageous for the high-pressure cleaning appliance to have a fuel pump for delivering the fuel required for operation of the heat exchanger, said fuel pump being connectable to a fuel container via a first fuel conduit in a maintenance-friendly manner and/or being connectable to the heat exchanger via a second fuel conduit in a maintenance-friendly manner. To this end, the first fuel conduit can, for example, be connectable to the fuel container and/or the fuel pump without the use of tools and in each case be secured by use of a fastener, clamp, or the like. In a corresponding manner, the second fuel conduit can be connectable to the fuel pump and/or heat exchanger without the use of tools and in each case be secured by use of a fastener, clamp, or the like.

It has already been mentioned that the at least one second functional device can take the form of a blower wheel for generating a flow of combustion air. Preferably, the first appliance unit has a housing for the blower wheel including a connection element for a combustion air channel connected to the heat exchanger, said combustion air channel being connectable to the connection element without the use of tools. This allows the first and the second appliance unit to be brought in spaced relation relative to one another in a more maintenance-friendly manner. The connection element may, for example, be configured in the form of a connection pipe over which the combustion air channel engages when the high-pressure cleaning appliance is in operation, or vice versa.

The following description of a preferred embodiment of the invention serves to explain the invention in greater detail in conjunction with the drawings.

DETAILED DESCRIPTION OF THE INVENTION

Figure 1:
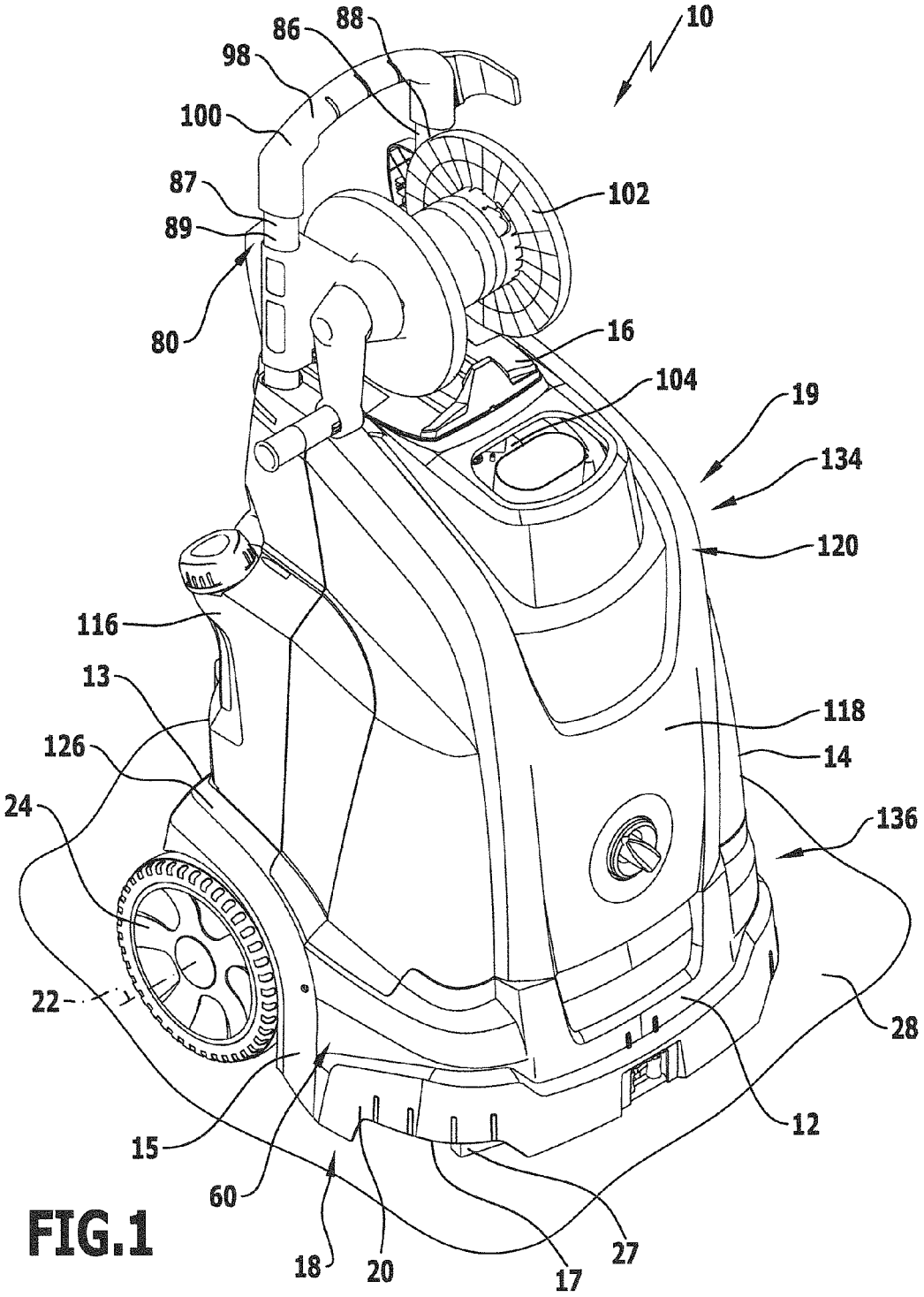
FIG. 1 is a perspective view of a high-pressure cleaning appliance in accordance with the invention, including a lower part and an upper part mounted thereon and comprising a housing having a housing wall and a hood.

A preferred embodiment of a high-pressure cleaning appliance in accordance with the invention is fully or partially shown in the perspective views of FIGS. 1 to 4 and generally designated therein by the reference numeral 10. The high-pressure cleaning appliance 10 has a front side 12, a back side 13, a left side 14, a right side 15, a top side 16 and a bottom side 17.

The high-pressure cleaning appliance 10 comprises a lower part 18, partially shown in FIGS. 6 and 7, and an upper part 19 mounted on the lower part 18, the construction of the upper part 19 being described in more detail below. The lower part 18 has a one-piece chassis 20 which is made of a plastics material and holds two wheels 23 and 24 rotatable about a common rotation axis 22 in the areas of transition from the left side 14 to the back side 13 and from the right side 15 to the back side 13.

On the bottom side 17 near the front side 12, the chassis 20 forms two support elements in the form of support legs 26 and 27. The high-pressure cleaning appliance 10 can stand on a set-down surface 28 via the support legs 26 and 27 and wheels 23 and 24.

Figure 5:
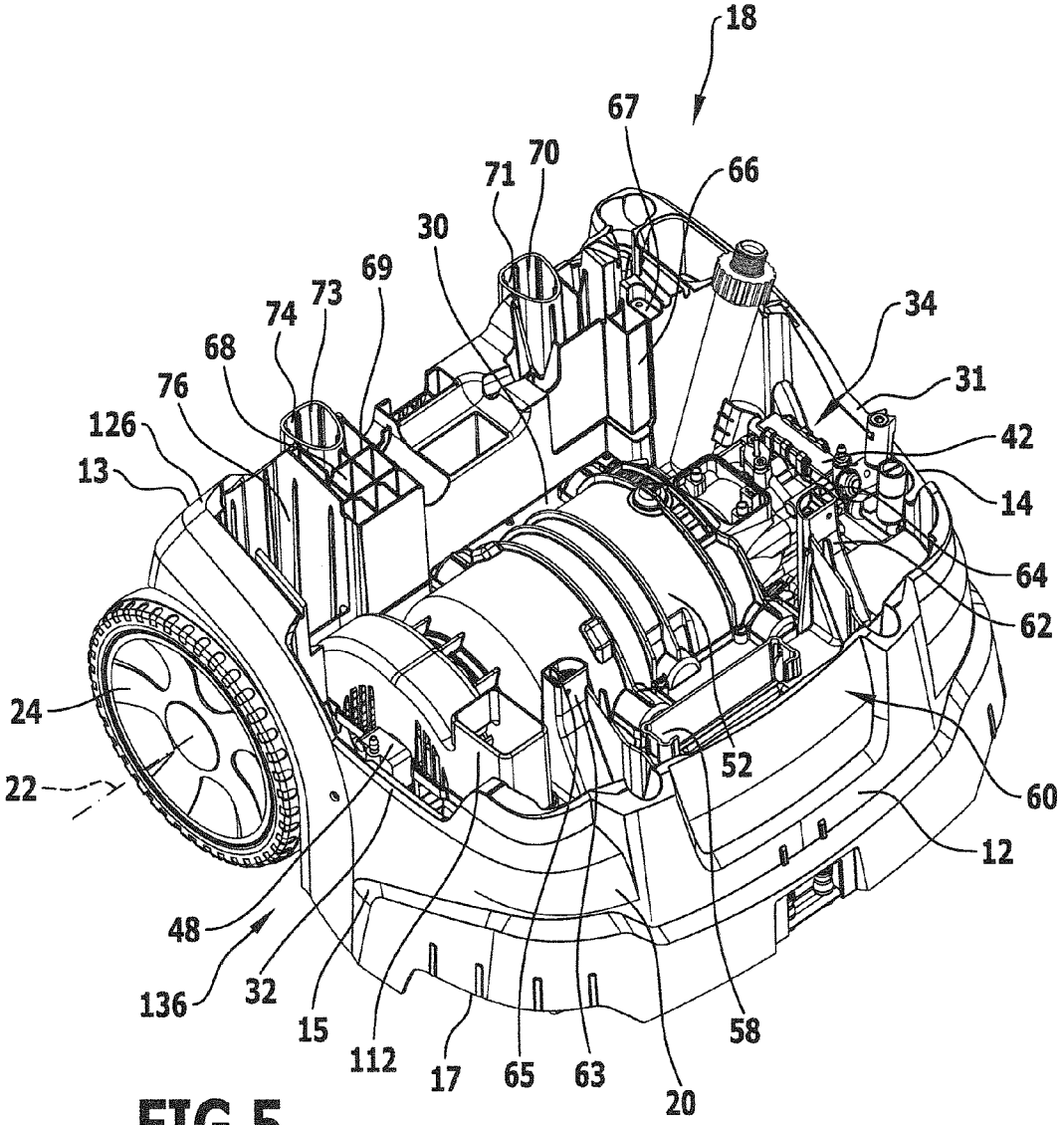
FIG. 5 is a perspective view of the lower part of the high-pressure cleaning appliance including a cover for functional devices of the high-pressure cleaning appliance on the upper side and with two electrical devices omitted.
Figure 6:
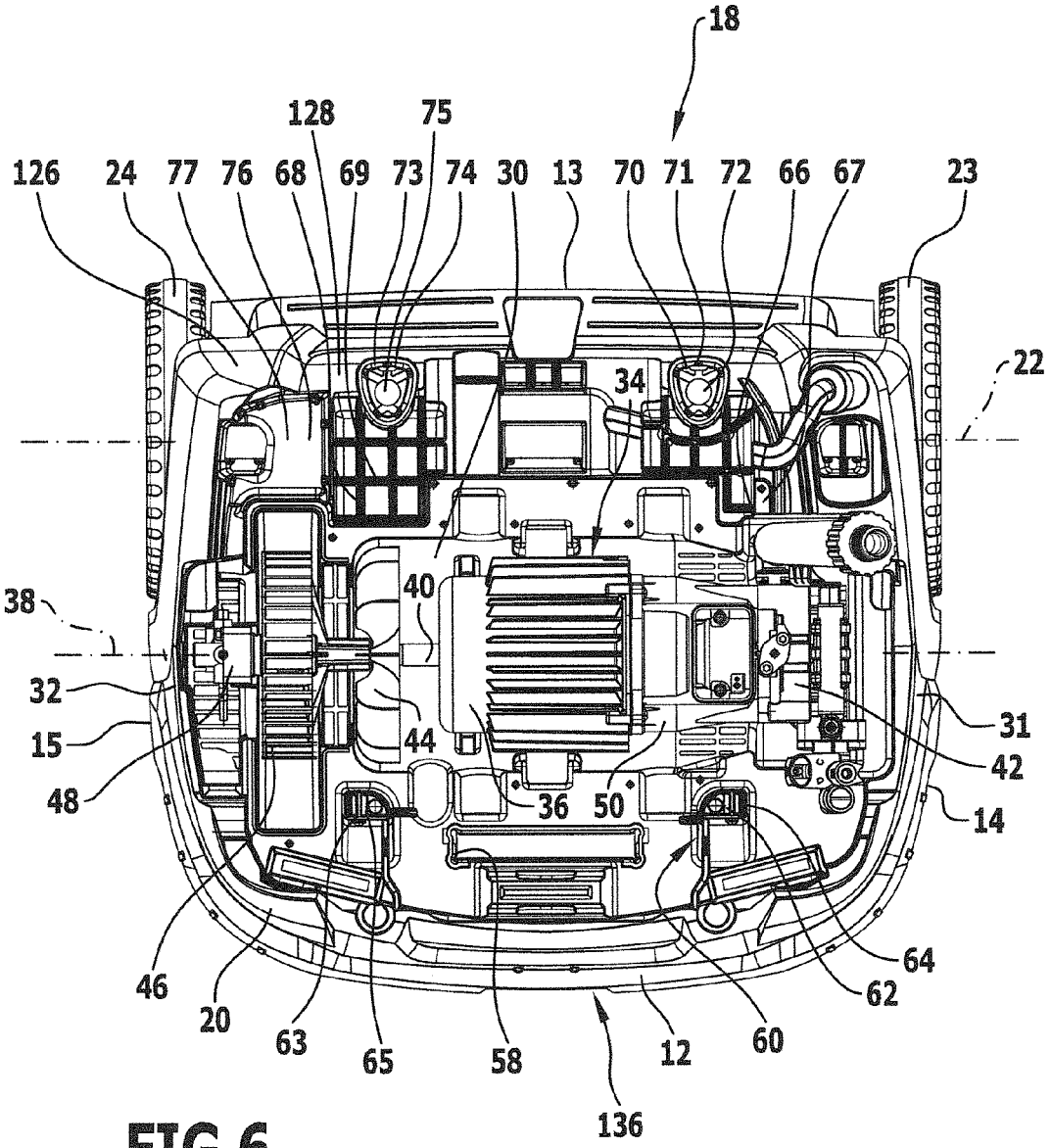
FIG. 6 is a top view of the lower part of FIG. 5 with the cover removed.

As can be seen from FIGS. 5 and 6 in particular, the chassis 20 forms a receptacle 30 located approximately centrally in the high-pressure cleaning appliance 10 relative to a longitudinal direction thereof and extending in a transverse direction thereof. The receptacle 30 extends from an edge 31 formed by the chassis 20 on the left side 14 up to an edge 32 formed by the chassis 20 on the right side 15. Inserted in the receptacle 30 is an assembly 34 of the high-pressure cleaning appliance 10.

The assembly 34 comprises a motor 36 having a drive shaft 40 defining a drive axis 38, a pump set 42, a wheel-shaped fan 44, a blower wheel 46 and a fuel pump 48. The pump set 42, which is configured as an axial piston pump, is flange-connected to and forms a unit 50 with the motor 36, which is configured as an electric motor. The pump set 42 and the fuel pump 48 form a first end near the left side 14 and a second end near the right side 15 respectively in an axial direction relative to the drive axis 38. The motor 36 is arranged centrally within the high-pressure cleaning appliance 10 relative to the transverse direction thereof. Located axially upstream of the motor 36 relative to the drive axis 38 is the fan 44 for generating a flow of air cooling the motor 36. Located axially upstream of the fan 44 is the blower wheel 46 for generating a flow of combustion air. The pump set 42, the fan 44, the blower wheel 46 and the fuel pump 48 can all be driven by the drive shaft 40.

The motor 36, the pump set 42, the fan 44, the blower wheel 46 and the fuel pump 48 each form a functional device of the high-pressure cleaning appliance 10 required for the operation thereof. The unit 50 and the assembly 34 as a whole can each also be regarded as a functional device of the high-pressure cleaning appliance 10.

The assembly 34 is held on the chassis 20 such that the drive axis 38 is oriented horizontally and parallel to the rotation axis 22. A cover 52 in the approximate shape of an inverted trough and extending in the transverse direction of the high-pressure cleaning appliance 10 covers the assembly 34 partially. In particular, the cover 52 covers the blower wheel 46, the fan 44 and approximately half of the unit 50 (FIG. 5).

Figure 3:
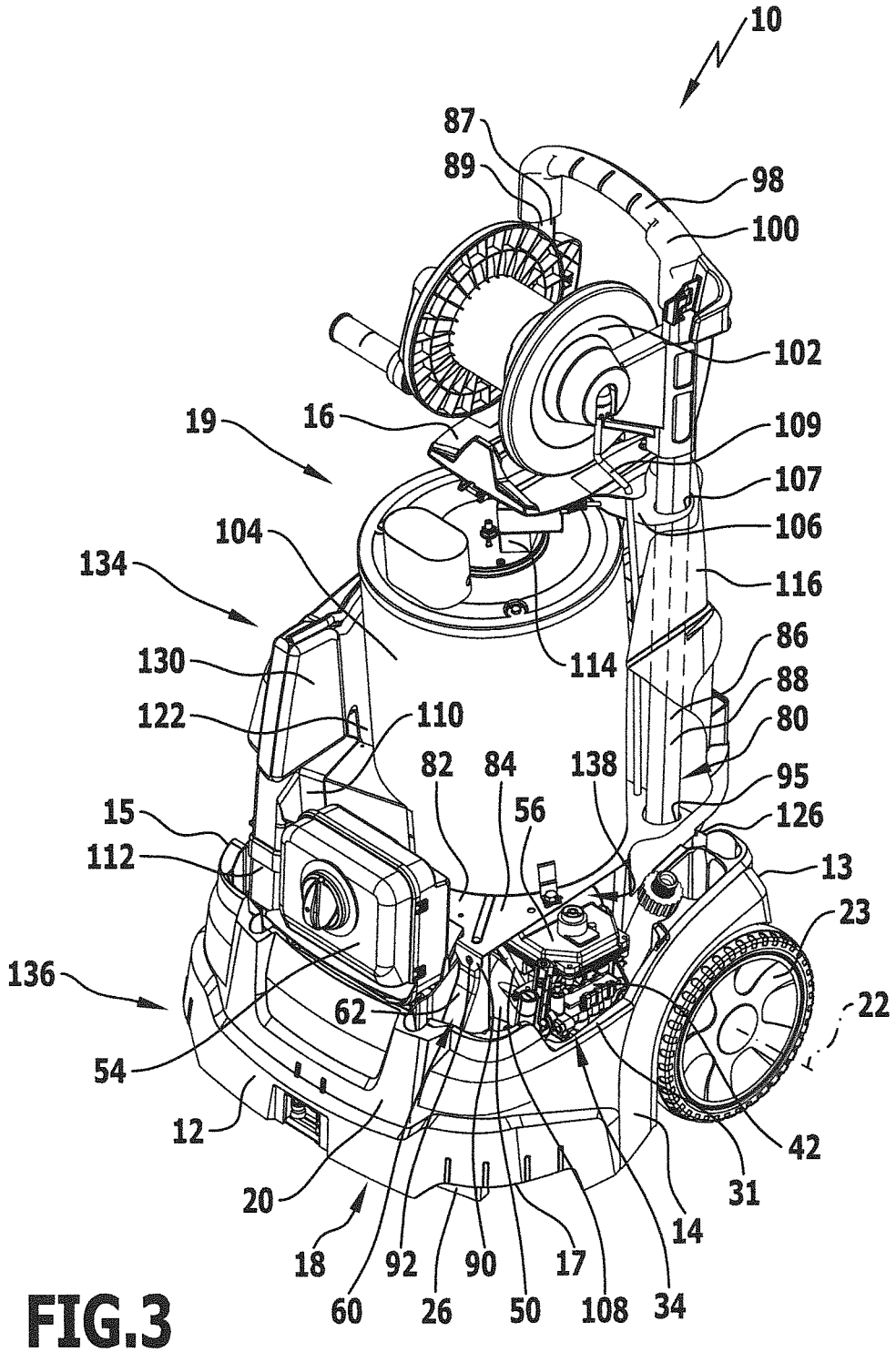
FIG. 3 is a further perspective view of the high-pressure cleaning appliance with the hood removed and the housing wall partially cut away.

In addition to the functional devices that have already been mentioned, the lower part 18 comprises two further functional devices, namely a first electrical device 54 and a second electrical device 56. The first electrical device 54 has a housing which is approximately cuboid in shape and is held near the front side 12 in a receptacle 58 provided therefor (FIGS. 3 and 7). The second electrical device 56 is releasably fixed to the upper side of the pump set 42.

The chassis 20 of the lower part 18 forms a support device 60 for the above-mentioned upper part 19, which cooperates with the support device 60 in a manner to be described hereafter.

Relative to the longitudinal direction of the high-pressure cleaning appliance 10, the chassis 20 forms two support elements 62 and 63 between the cover 52 and the receptacle 58 (FIGS. 5 and 6). Relative to the transverse direction of the high-pressure cleaning appliance 10, the support element 62 is located approximately at the level of the middle of the unit 50 and the support element 63 is located approximately at the level of the fan 44. The support elements 62 and 63 form abutment areas and in particular support areas 64 and 65 respectively on their upper sides.

The chassis 20 forms a further, complexly designed support element 66 opposite the support element 62 relative to the drive axis 38 approximately at the level of the rotation axis 22 relative to the longitudinal direction of the high-pressure cleaning appliance 10. The support element 66 has a plurality of walls interconnected for reasons of stability and extending in the longitudinal and transverse directions of the high-pressure cleaning appliance 10. The support element 66 forms a partially shoulder-shaped support area 67 on its upper side.

The chassis 20 forms a further support element 68 on the side of the support element 63 opposite the drive axis 38 relative to the longitudinal direction of the high-pressure cleaning appliance 10. The support element 68 comprises a plurality of walls interconnected for rigidity and extending in a direction of height, thereby forming a grid-shaped support area 69 on its surface. The support elements 62, 63, 66 and 68 are dimensioned such that their support areas 64, 65, 67 and 69 respectively define a horizontal supporting plane for a carrying part of the high-pressure cleaning appliance 10 which is to be described hereinafter.

Adjacent to the support element 66 in the direction of the back side 13, the chassis 20 forms a receptacle 70 in the form of a sleeve 71 having a bottom 72. The sleeve 71 extends in a height direction and has a cross-section in the approximate shape of a triangle with convex sides. Correspondingly, the chassis 20 forms a receptacle 73 in the form of a sleeve 74 adjacent to the support element 68 in the direction of the back side 13. The sleeve 74 likewise extends in a height direction, has a cross-section in the approximate shape of a triangle with convex sides, and is delimited by a bottom 75 on its underside.

Adjacent to the support element 68 and the sleeve 74 in the direction of the right side 15, the chassis 20 forms a shaft-shaped receptacle 76, the underside of which is delimited by a bottom wall 77.

To connect the upper part 19 with the lower part 18 in the assembled state of the high-pressure cleaning appliance 10, the upper part 19 has a carrying device 80 which is releasably connectable, in the manner described hereinafter, with the support device 60 formed by the chassis 20. The carrying device 80 comprises a first carrying part 82 in the form of a flat carrier plate 84 and two second carrying parts 86 and 87 in the form of two profile bars 88 and 89, for example of a metal material.

Figure 2:
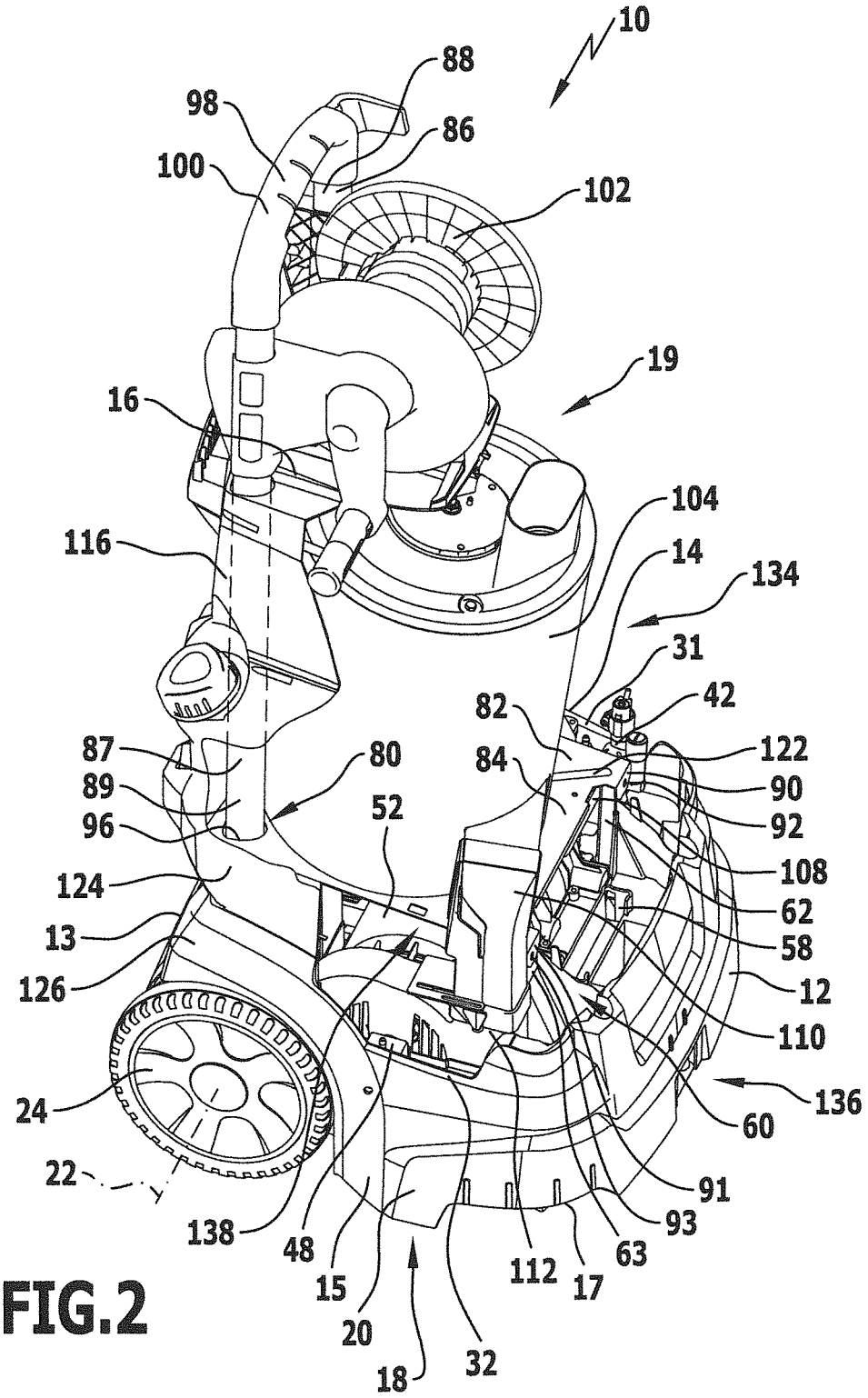
FIG. 2 is a further perspective view of the high-pressure cleaning appliance with the hood removed and two electrical devices and a fuel container omitted and the housing wall partially cut away.

The carrier plate 84 is a one-piece construction, and made for example of a metal material, and is horizontally supported on the support areas 64, 65, 67 and 69 of the support elements 62, 63, 66 and 68 respectively. On the side thereof facing towards the front side 12, the carrier plate 84 has two bent-over straps 90 and 91 which are releasably fixed to the support elements 62 and 63 respectively by two connecting elements, such as screws, 92 and 93 respectively (FIGS. 2 and 3). Further, by way of an additional connecting element, not shown in the drawing, the carrier plate 84 is releasably connectable to the support element 66 at the shoulder-shaped support area 67 thereof.

The profile bars 88 and 89 are arranged in a positively-locked manner in the receptacles 70 and 73 respectively and supported on the bottoms 72 and 75 of the receptacles respectively, although this is not illustrated in the drawing. They extend in a height direction. Above the receptacles 70 and 73, near the back side 13, the profile bars 88 and 89 pass through through-holes 95 and 96 of the carrier plate 84 respectively (FIGS. 2 and 3). The profile bars 88 and 89 are fixed, for example screwed, to the carrier plate 84 in the area of the through-holes 95 and 96 respectively. This is not illustrated in the drawing.

The profile bars 88 and 89 are connected together at their ends facing away from the support device 60 by a connecting member 98. The connecting member 98 forms a handle in the form of a grip element 100 for the high-pressure cleaning appliance 10. A user can grasp the high-pressure cleaning appliance 10 by the grip element 100 and tilt it about the support points of the wheels 23 and 24 on the set-down surface 28. This makes it possible to move the high-pressure cleaning appliance 10 on the set-down surface 28 in a manner similar to that of a hand truck.

A functional device receptacle of the high-pressure cleaning appliance 10 in the form of a hose reel 102 is held on the profile bars 88 and 89 below the connecting member 98. The hose reel 102 serves to store a high-pressure hose via which liquid pressurized by the high-pressure cleaning appliance 10 can be discharged.

The upper part 19 comprises a further functional device of the high-pressure cleaning appliance 10 in the form of a heatable heat exchanger 104 that is held standing upright on the carrier plate 84. On its upper side, which faces away from the carrier plate 84, the heat exchanger is connected to a plate-shaped holding element 106 through which the profile bars 88 and 89 extend via two through-holes. Only one of these, namely through-hole 107 through which the profile bar 88 extends, is shown in FIG. 3 of the drawing. In the area of the through-hole 107 and the through-hole not shown, the profile bars 88 and 89 are connected to the holding element 106 in a fixed manner. This is likewise not illustrated in the drawing.

The heat exchanger 104 serves to heat a cleaning liquid, in particular water, pressurized by the pump set 42. It is connected to the pump set 42 via a liquid discharge conduit 108 which is releasably fixed to the pump set 42 without the use of tools. The liquid discharge conduit 108 could also be releasably connected to the heat exchanger 104 without the use of tools. The liquid heated by the heat exchanger 104 can be discharged by way of a second liquid discharge conduit 109, with the liquid discharge conduit 109 entering the hose reel 102 to connect to the above-mentioned high-pressure hose.

Combustion air for the heat exchanger 104 is generated using the blower wheel 46, which can be driven by the motor 36, and supplied to the heat exchanger 104 by way of a combustion air channel 110. The combustion air channel 110 engages over a connection element 112 in the shape of a connection pipe which is formed by the cover 52 and from which it can be released without the use of tools.

Electrically operative components of the heat exchanger 104, such as a thermostat arranged at the upper side thereof and not shown in the drawing, and an ignition device 114 at the upper side thereof to ignite a mixture of combustion air and fuel are connected with the first electrical device 54 via electrical lines, not shown in the drawing, by the use of plug connections. Therefore, these electrical lines can be released from the thermostat, the ignition device 114 and the electrical device 54 without the use of tools.

Held on the profile bars 88 and 89 is a housing wall 116 which together with a hood 118 forms a housing 120 of the high-pressure cleaning appliance 10. The profile bars 88 and 89 are passed through the housing wall 116 below the hose reel 102 and above the holding element 106. The housing wall 116 is arranged on the back side 13 and the left side 14 and right side 15 sections that face towards the back side. The hood 118 is arranged on the front side 12 and the left side 14 and right side 15 sections that face towards the front side and is releasably fixed to the lower part 18 and housing wall 116. The hood 118 delimits the upper side of an interior space 122 below the housing 120, thereby covering the above-mentioned functional devices of the high-pressure cleaning appliance 10.

Figure 4:
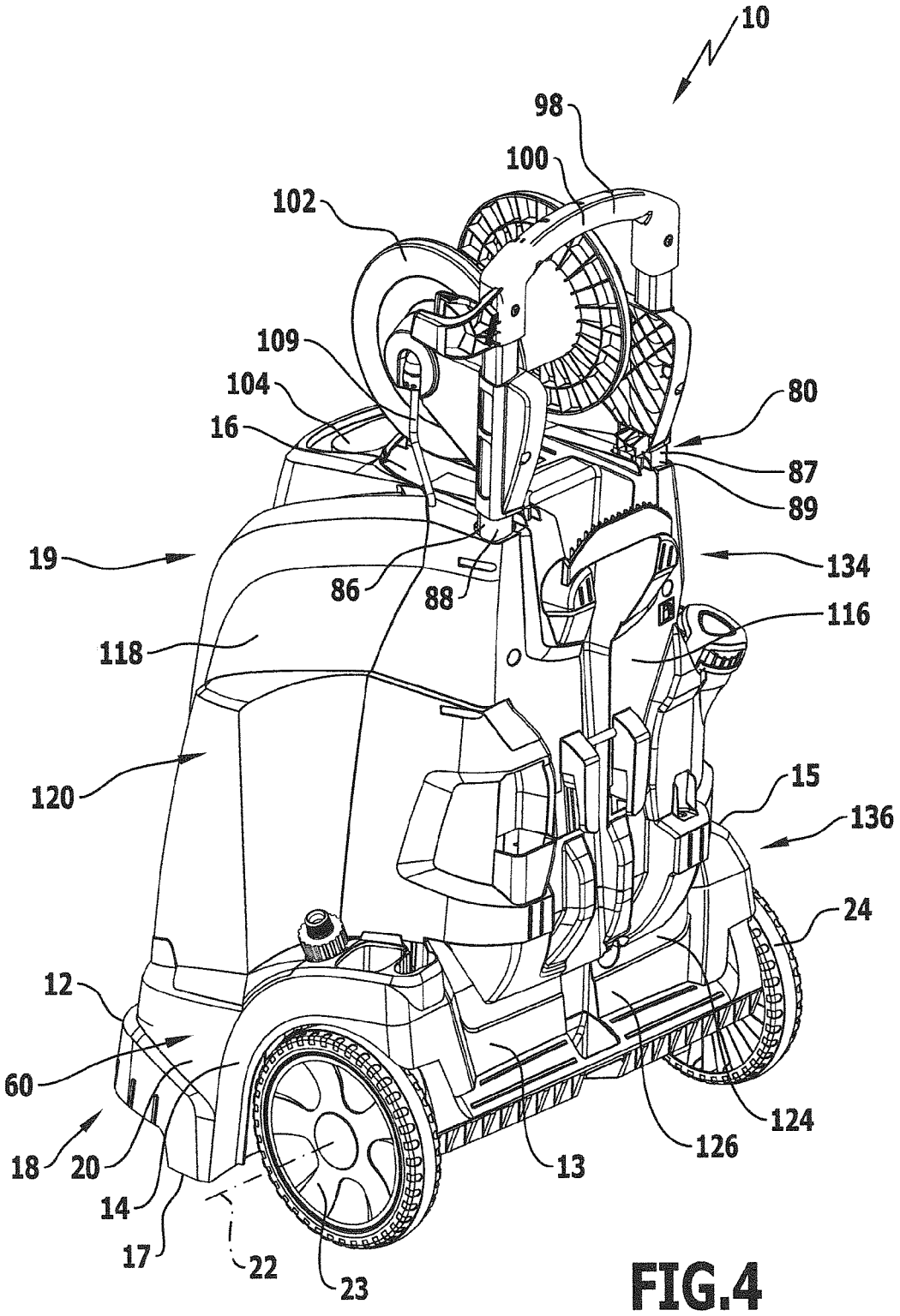
FIG. 4 is a further perspective view of the high-pressure cleaning appliance.

A lower edge 124 of the housing wall 116 engages in a positively-locked manner in an edge 126 formed by the chassis 20 on the back side 13 and on the left side 14 and right side 15 above the wheels 23 and 24 respectively. The edge 126 borders a trough-shaped depression 128, formed by the chassis 20, from which inter alia the support elements 66 and 68 and the sleeves 71 and 74 project and extend in a height direction (FIGS. 4 to 6). In this manner, the upper part 19, with the housing wall 116, engages in a positively-locked manner in the lower part 18 and in particular in the chassis 20 thereof. In addition to this positively-locked connection between the upper part 19 and the lower part 18, the previously discussed positively-locked connection by the profile bars 88 and 89 engaging in the sleeves 71 and 74 and the force-locked connection by the carrier plate 84 being supported on the support elements 62, 63, 66 and 68 exist between the upper part 19 and the lower part 18.

Held on the housing wall 116 adjacent to the heat exchanger 104 near the right side 15 is a functional device of the high-pressure cleaning appliance 10 in the form of a fuel container 130 for a fuel required for operation of the heat exchanger 104. The fuel container 130 is arranged in an interspace between the heat exchanger 104 and the housing 120 and forms a support element 132 (FIG. 7) which engages in the shaft-shaped receptacle 76 in a positively-locked manner and abuts the bottom wall 77 thereof. This forms an additional positively-locked connection between the upper part 19 and the lower part 18.

The fuel container 130 is connected by a first fuel conduit, not illustrated in the drawing, to the fuel pump 48, which is connected to the heat exchanger 104 by a second fuel conduit, likewise not shown in the drawing. In this manner, the heat exchanger 104 can be supplied with fuel by use of the fuel pump 48. The first fuel conduit and the second fuel conduit are connected, in a releasable and maintenance-friendly manner, to the fuel container 130 and fuel pump 48 and to the fuel pump 48 and heat exchanger 104 respectively and are in each case fixed thereto with a fastener, clamp, or the like.

The high-pressure cleaning appliance 10 in accordance with the invention is distinguished by being maintenance friendly despite its compact design, in which the assembly 34 is installed below the heat exchanger 104. To expose the assembly 34, the user can remove the hood 118 of the housing 120 so that the high-pressure cleaning appliance 10 essentially appears to the user as indicated by FIG. 3. To release the upper part 19, which forms a first appliance unit 134 of the high-pressure cleaning appliance 10, from the lower part 18, which forms a second appliance unit 136 of the high-pressure cleaning appliance 10, the user can, for example, subsequently proceed as follows:

The user can release the connecting elements 92 and 93, which connect the carrier plate 84 to the support elements 62 and 63 respectively, and the third connecting element, not shown in the drawing, which connects the carrier plate 84 to the support element 66. The liquid discharge conduit 108 can be released from the pump set 42 without the use of tools. Furthermore, the electrical lines, not shown in the drawing, can be released without the use of tools. The fuel conduits, likewise not illustrated in the drawing, can be released for example from the fuel pump 48, heat exchanger 104 or fuel container 130.

Subsequently, the upper part 19 can be brought in spaced relation relative to the lower part 18, for example by a user grasping the upper part 19 by the grip element 100. This releases the connection between the carrying device 80 and the support device 60, in particular the force-locked connection of the carrier plate 84 with the support elements 62, 63, 66 and 68 and also the positively-locked connection of the profile bars 88 and 89 with the receptacles 70 and 73 respectively. In addition, the positively-locked connection between the lower edge 124 of the housing wall 116 and the edge 126 of the chassis 20 is released, as is the positively-locked connection between the support element 132 of the fuel container 130 and the receptacle 76.

The combustion air channel 110 is released from the connection element 112 automatically when the upper part 19 is brought in spaced relation relative to the lower part 18 because the combustion air channel 110 simply engages over the connection element 112.

Figure 7:
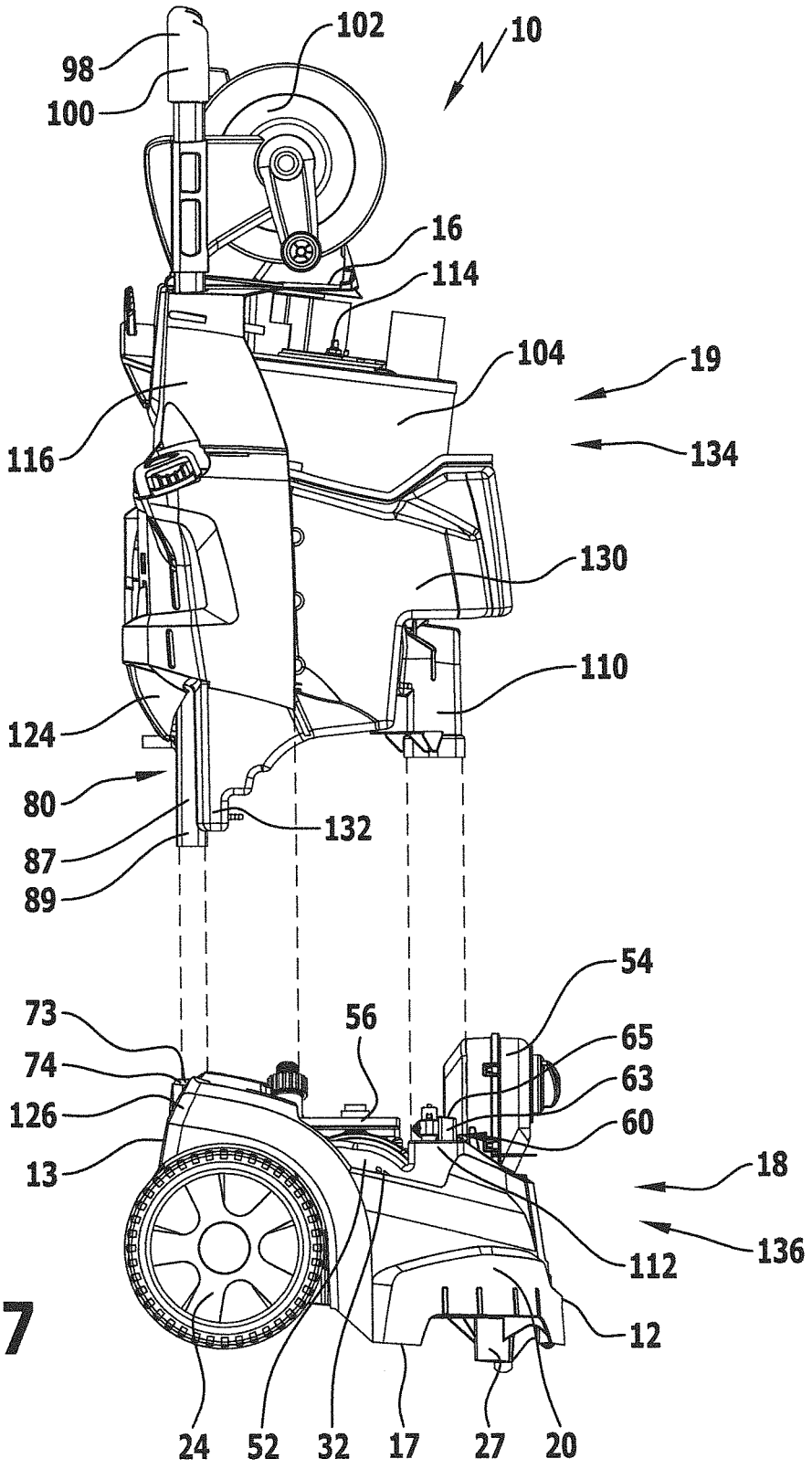
FIG. 7 is a side view of the high-pressure cleaning appliance with the hood removed, wherein the upper part and the lower part assume a spaced relation to one another.

Subsequently, the high-pressure cleaning appliance 10 can, for example, essentially assume the relative arrangement of the upper part 19 and the lower part 18 to each other as indicated by FIG. 7. A receiving space 138 formed below the carrier plate 84 and covered by the latter on the upper side is freely accessible to the user in this manner. The assembly 34 is arranged in the receiving space 138 so as to be partially covered by the cover 52. Therefore, the lower part 18 essentially appears to a user as shown in FIG. 5, with the electrical devices 54 and 56 additionally arranged on the lower part 18.

The cover 52, now freely accessible to the user, can be easily released by the user so that he/she has access to the complete assembly 34, the individual components thereof and thus to numerous functional devices of the high-pressure cleaning appliance 10. The user can perform the necessary maintenance work on these functional devices.

It is, in particular, possible to perform a test operation of the high-pressure cleaning appliance 10 when the latter is in the disassembled state. In order to accomplish this, the above-mentioned fuel conduits, electrical lines, and a liquid discharge conduit that assumes the function of the liquid discharge conduit 108, or the liquid discharge conduit 108 itself would have to be functionally reconnected. During the test run, the assembly 34 can continue to be held on the support device 60 and the heat exchanger 104 can continue to be held on the carrying device 80.

It is clear from the above-described exemplary procedure used to bring the upper part 19 in spaced relation to the lower part 18 that the high-pressure cleaning appliance 10 is distinguished by being very maintenance friendly. Functional devices, in particular the assembly 34 and its components, arranged in the receiving space 138 below the carrier plate 84 can be easily accessed by a user once the carrying device 80 has been released from the support device 60.

Furthermore, the high-pressure cleaning appliance 10 is distinguished by being easily reassembled. To this end, the user can proceed, for example, in reverse order to that described above for separating the upper part 19 and lower part 18 from one another.

The invention claimed is:

1. High-pressure cleaning appliance, comprising:

a first functional device required for operation comprising a heatable heat exchanger for heating a liquid that is dischargeable from the high pressure cleaning appliance, at least one further, second functional device required for operation which is arranged below the heat exchanger, a first appliance unit comprising a carrying device and the heat exchanger, and a second appliance unit comprising a support device on which the at least one further second functional device is held, wherein:

the carrying device is releasably connectable to the support device in at least one of a force-locked and positively-locked manner, the carrying device comprises a carrying part for holding the heat exchanger, said carrying part being releasably connectable to two or more vertical support elements comprised by the support device, the carrying part has a plate-shaped configuration and forms a supporting surface on top of which the heat exchanger is held, and the two or more vertical support elements form corresponding abutment faces for the carrying part on the respective sides of the vertical support elements that face towards the first appliance unit, each of the abutment faces comprising a horizontal support area on top of which the carrying part rests.

2. High-pressure cleaning appliance in accordance with claim 1, wherein the at least one further second functional device is configured as at least one of a pump set for increasing a pressure of the liquid that is discharged, a motor for the pump set, a fan for generating a flow of air for cooling the motor, a blower wheel for generating a flow of combustion air for the heat exchanger, a fuel pump for delivering a fuel for the heat exchanger, and an electrical device of the high-pressure cleaning appliance.

3. High-pressure cleaning appliance in accordance with claim 1, wherein the at least one further second functional device or a cover of the at least one further second functional device is freely accessible to a user after releasing the carrying device from the support device.

4. High-pressure cleaning appliance in accordance with claim 1, wherein a receiving space for the at least one further second functional device is formed below the carrying part.

5. High-pressure cleaning appliance in accordance with claim 1, wherein:

the carrying device comprises at least one further carrying part which is fixed to the carrying part for holding the heat exchanger, and the support device comprises at least one receptacle for the at least one further carrying part.

6. High-pressure cleaning appliance in accordance with claim 5, wherein the at least one further carrying part engages in the at least one receptacle in a positively-locked manner.

7. High-pressure cleaning appliance in accordance with claim 5, wherein the at least one further carrying part is configured as a profile bar extending in a direction of height.

8. High-pressure cleaning appliance in accordance with claim 1, wherein the carrying device comprises two further carrying parts which are fixed to the carrying part for holding the heat exchanger.

9. High-pressure cleaning appliance in accordance with claim 1, further comprising a housing comprising at least one housing wall which is held on the carrying device.

10. High-pressure cleaning appliance in accordance with claim 9, wherein:

the support device forms a trough-shaped depression in which the first appliance unit is partially arranged, and an edge bordering the depression abuts a side of the at least one housing wall which faces towards the support device.

11. High-pressure cleaning appliance in accordance with claim 1, wherein the first appliance unit further comprises at least one of at least one additional functional device required for operation of the high-pressure cleaning appliance and a functional device receptacle for an additional functional device.

12. High-pressure cleaning appliance in accordance with claim 11, wherein the first appliance unit further comprises at least one of a fuel container for a fuel required for operation of the heat exchanger and a hose reel to receive a high-pressure hose.

13. High-pressure cleaning appliance in accordance with claim 1, further comprising a pump set for increasing a pressure of the liquid that is discharged, said pump set being connected to the heat exchanger via a liquid discharge conduit, wherein the liquid discharge conduit is releasably connectable to at least one of the pump set and the heat exchanger without use of tools.

14. High-pressure cleaning appliance in accordance with claim 1, further comprising an electrical device held on the support device, wherein electrically operative components of the heat exchanger and the electrical device are interconnectable via one or more electrical lines without use of tools.

* * * * *